US005255006A

United States Patent [19]

Pappas et al.

[11] Patent Number: 5,255,006

[45] Date of Patent: Oct. 19, 1993

[54] COLLAPSIBLE APPARATUS FOR FORMING A DISH SHAPED SURFACE

[75] Inventors: Peter R. Pappas, Sunnyvale; Stephen R. Turner, Fremont; John P. Ciampaglia, Mt. View, all of Calif.

[73] Assignee: Space Systems/Loral, Inc., Palo Alto, Calif.

[21] Appl. No.: 751,719

[22] Filed: Aug. 29, 1991

[51] Int. Cl.[5] ..... H01Q 15/20

[52] U.S. Cl. ..... 343/915; 343/912; 343/916; 403/DIG. 1

[58] Field of Search ..... 343/915, 912, 916, 914, 343/840; 403/DIG. 1; 439/916

[56] References Cited

U.S. PATENT DOCUMENTS 3,715,760 2/1973 Palmer ..... 343/915
4,511,901 4/1985 Westphal ..... 343/915
4,862,190 8/1989 Palmer et al. ..... 343/915
4,893,132 1/1990 Habibi ..... 343/915

*Primary Examiner*—Rolf Hille
*Assistant Examiner*—Hoanganh Le
*Attorney, Agent, or Firm*—Kenneth M. Kaslow; Edward J. Radlo

[57] ABSTRACT

A collapsible, dish shaped assembly, for example, for use with a satellite. The dish shaped surface is assembled from two sets of rigid panels. The first set of panels is rotated into position on hinges, which attach the panels to a base. The second set of panels is then rotated into position, also on hinges at the base, such that the second set of panels fill in the spaces between the panels of the first set. A latch connects each pair of adjoining panels. The latch comprises a protrusion which slides into a corresponding cavity. The resulting latch is resistant to lateral force. The latching process is facilitated by magnetic forces, which also add to the final latching force. The latches can be disengaged by jacking screws.

21 Claims, 4 Drawing Sheets

COLLAPSIBLE APPARATUS FOR FORMING A DISH SHAPED SURFACE

BACKGROUND OF THE INVENTION

1. Field of the Invention

This invention relates to a dish shaped apparatus and, more particularly, to a collapsible dish shaped apparatus, the surface of which is used, for example, as an antenna to collect or reflect light or radio waves or other forms of electromagnetic energy.

2. Description of the Prior Art

Objects to be sent into space need to be as compact and as light weight as possible. At the same time, it is usually necessary to provide space satellites with antennae which include comparatively large, dish shaped surfaces. Therefore, it is necessary to find a means of compactly packing a dish shaped surface so that it may be assembled after deployment of the satellite in space. It is also desirable to find a means of latching the various parts of the dish shaped surface to one another, after it is assembled, to increase the stability of the structure.

The prior art contains two attempts to resolve this problem. (Holland, U.S. Pat. No. 3,176,303, issued Mar. 30, 1965, and Emde, U.S. Pat. No. 3,618,101, issued Nov. 2, 1971.) The device of Holland achieves compactness by the use of flexible panels. The dish shaped surface is compacted by contracting its circumference, forcing adjacent panels to overlap. The apparatus is held in the compact shape by restraining means, which are released after the satellite is deployed. The natural resilience of the panel material restores the apparatus to approximately its original dish shape.

The device of Holland has three disadvantages. First, by the nature of the flexible materials used for the panels, it is not certain that the original shape of the dish will be exactly restored, when the restraining means are released. Second, the nature of the flexible materials makes it impractical to repeatedly test the assembly and disassembly of the apparatus before launch, since most materials lose their resilience after repeated contraction and release. Third, the means of latching adjacent panels is unsatisfactory, since the Holland device uses shallow depressions containing magnets. The depressions must be shallow, because the expanding panel surfaces slide over each other into their final positions. However, such shallow latching mechanisms provide minimal lateral holding force, i.e. the force necessary to resist so-called "barrel torque."

The Emde device achieves compactness with rigid panels by stacking them sequentially on top of each other. Assembly requires two motions for each panel: first a rotation around a central axis, followed by a vertical motion with respect to that same axis to drop the panel into its place in the final configuration.

The device of Emde avoids the disadvantages associated with panels made of flexible, resilient material. However, the device of Emde still has two disadvantages. First, it shares with the Holland device the disadvantage that the panels slide over each other and therefore it is difficult to provide for a latch that will resist barrel torque. Second, the necessity that each panel move sequentially in two different directions involves an undesirable complexity that is particularly inappropriate for a device usually meant to be assembled automatically.

Attention is also called to Kaminskas, U.S. Pat. No. 4,811,034, issued Mar. 7, 1989, which shows a device which operates in a similar fashion to that of Emde. However, it also shares the disadvantages of the device of Emde.

SUMMARY OF THE INVENTION

In order to avoid the above difficulties in the present invention, the apparatus is assembled from panels in two or more stages, in a fashion which makes possible the use of rigid, rather than flexible, panels. This means that, upon deployment, the surface will be exactly the desired shape, with no variation resulting from the use of flexible material. The panels of the second or later stages descend into position from above the panels of the first or earlier stages, rather than sliding over them. This makes possible a latching mechanism which resists lateral or "barrel torque" dislocation. Finally, the latching mechanism is provided with a release mechanism. This makes possible repeated assembly and disassembly of the apparatus for testing purposes without damage to the light weight and therefore delicate panels.

DETAILED DESCRIPTION OF THE PREFERRED EMBODIMENT

Figure 1:
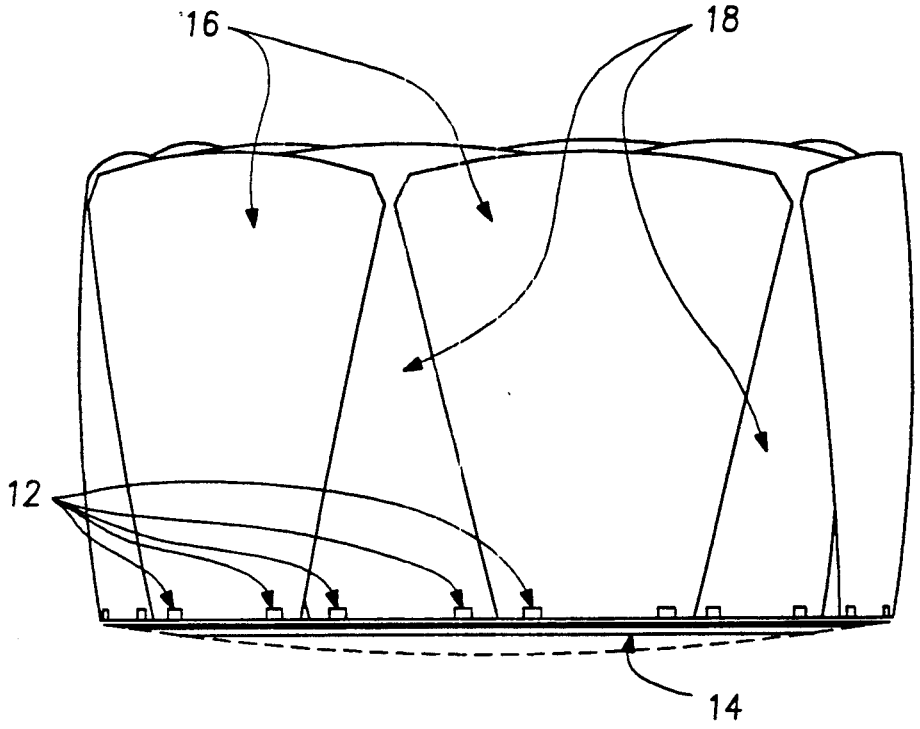
FIG. 1 is a simplified drawing of the apparatus of the present invention, with the panels in the folded position.
Figure 2:
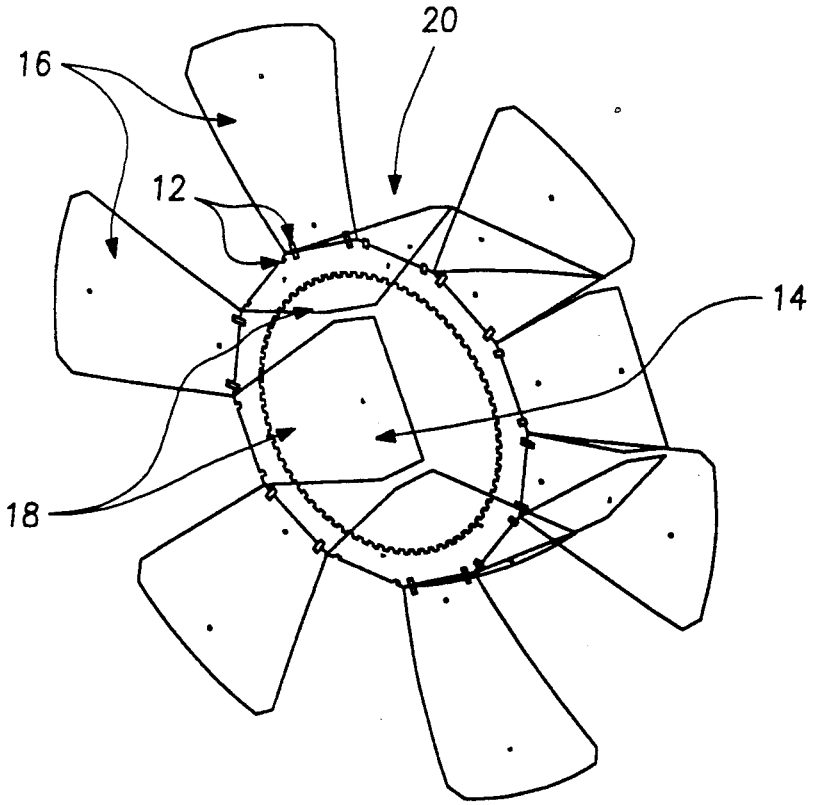
FIG. 2 shows the apparatus of FIG. 1 after the first set of panels has been rotated outward into the assembled position.
Figure 3:
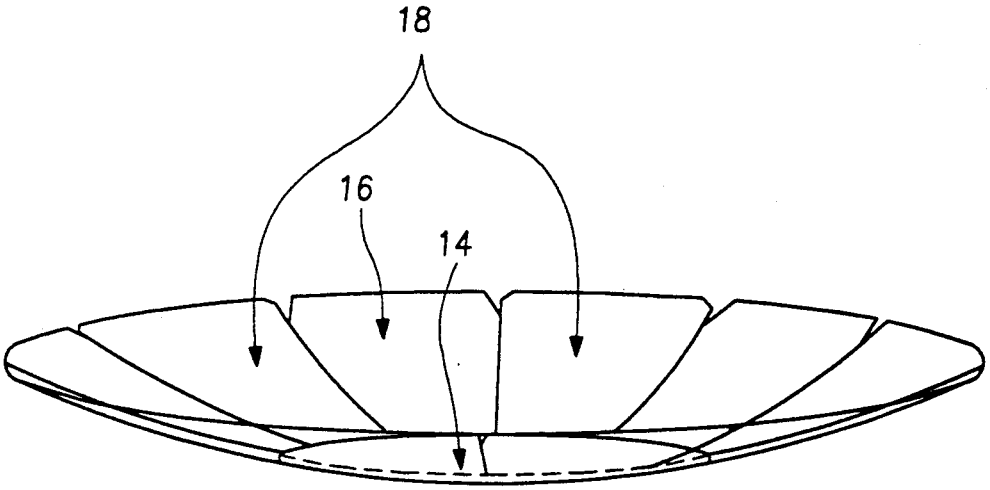
FIG. 3 shows the apparatus of FIG. 1 after the second set of panels has also been rotated outward into the assembled position to create the dish shaped surface.

FIG. 1 shows the apparatus of the present invention in the folded or collapsed configuration. Two sets of alternating panels 16 and 18 are attached by appropriate means such as hinges 12 around the circumference of a mounting base 14. In the preferred embodiment, as shown in FIGS. 1 to 3, there are twelve panels, but any number is possible. As shown in FIG. 1, in the collapsed position all the panels 16 and 18 are rotated inward on the hinges 12 to achieve the desired compactness.

After the apparatus has been carried into space, and the satellite has been deployed, the dish shaped surface can be assembled. First, the first set of panels 16 are rotated into the desired positions, rotating on their hinges 12 outward and downward. In the preferred embodiment, this rotation is achieved by the release of spring mechanisms at the hinges 12, which attach the panels 16 to the base. The remaining panels 18 remain in their collapsed configuration positions. FIG. 2 shows the apparatus partially assembled, after the first set of panels 16 has been rotated into position. Spaces 20 are left between adjacent panels.

Next, the second set of panels 18 is rotated outward and downward into position. In the preferred embodiment, the second set of panels 18 includes all the remaining panels, so that this step completes the assembly of the surface. FIG. 3 shows the apparatus fully assembled with all panels in position.

Figure 4:
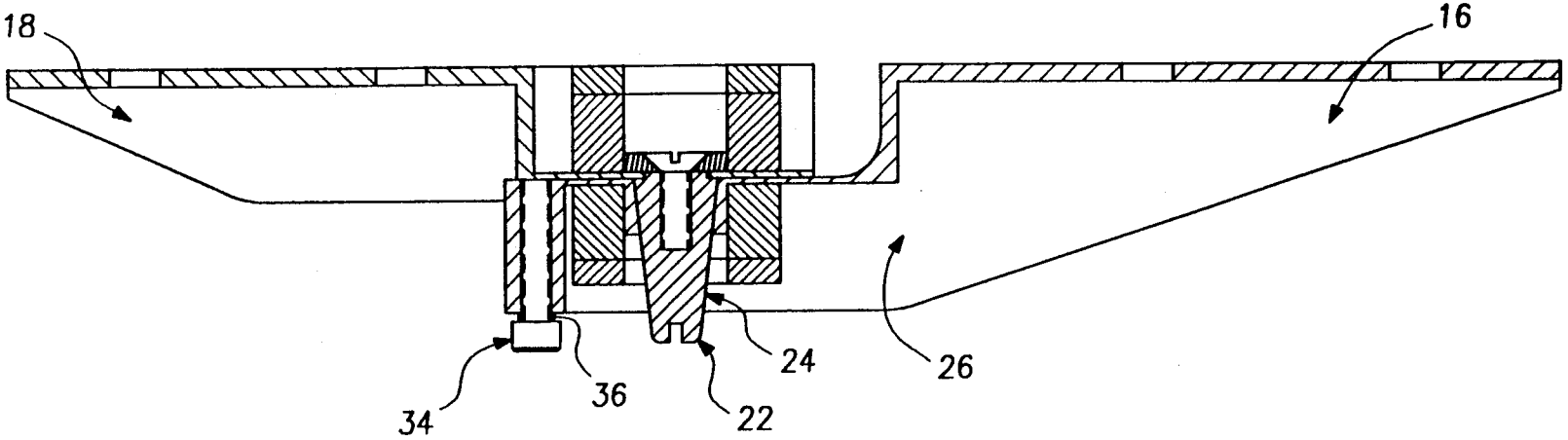
FIG. 4 is a cross sectional view of one latching mechanism.
Figure 5:
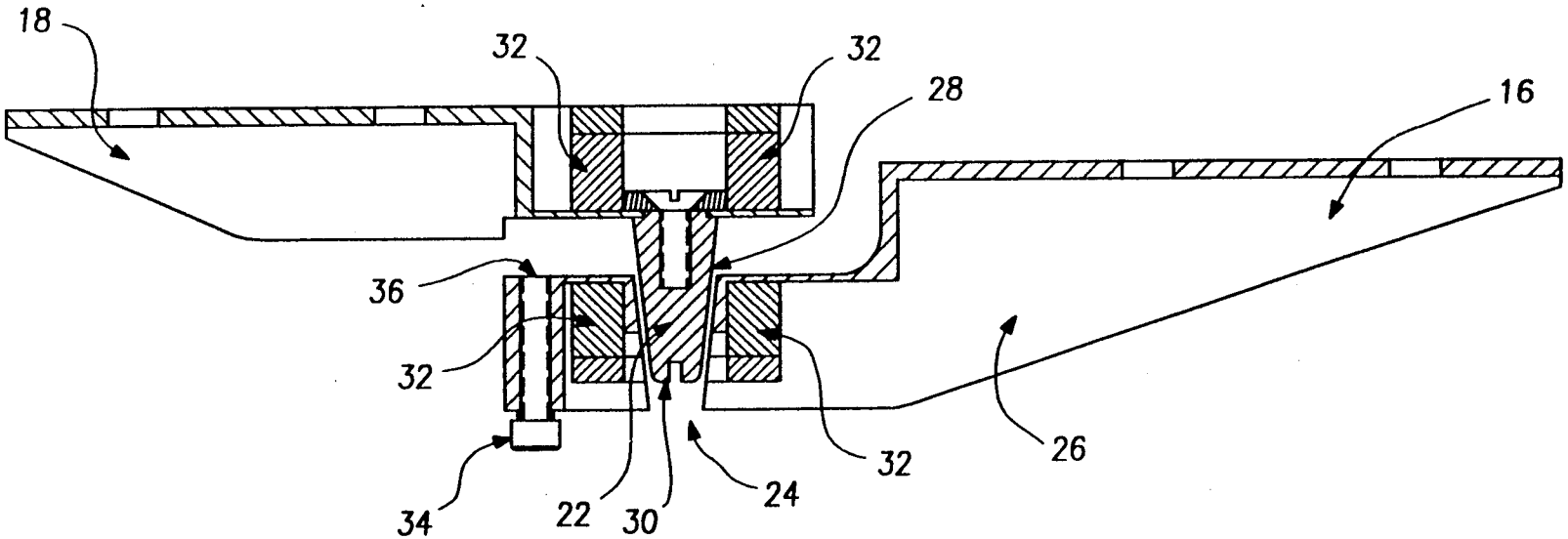
FIG. 5 shows the latching mechanism of FIG. 4 just prior to engagement, i.e. as a later panel descends into position next to an earlier panel.

As the later panels are rotated into position, the latching mechanisms are engaged. In the preferred embodiment, the latching mechanism consists of a protruding member 22 attached at the side of the descending, later panel 18, which enters a corresponding cavity 24 in a structure 26 attached to the edge of the panel 16 already in position, as shown in FIGS. 4 and 5.

The protruding member 22 may be any of a variety of shapes. In order to achieve the desired lateral holding force, i.e. resistance to so-called "barrel torque," in the preferred embodiment some portion of the surface of the protruding member 22 is inclined at an angle of greater than forty-five degrees with respect to the surface of the panel 18 to which the member 22 is attached.

Generally, member 22 will be either substantially a cone in shape or substantially a frustum in shape. "Cone" as used herein means any solid determined by a connected region of a plane, called the "base", and a point off that plane, called the "apex." A cone is, then, the set of all points on all straight lines connecting any point of the base to the apex. A frustum is the solid defined by any truncation of a cone by a second, intersecting plane.

In the preferred embodiment, the member 22 has substantially the shape of a frustum of a right circular cone. A circular cone is a cone whose base is a circle. A right circular cone is a circular cone in which the line from the apex to the center of the base is perpendicular to the base. In the preferred embodiment, the right circular cone is truncated by a plane parallel to the plane of the base.

In the preferred embodiment, the sides of the member 22 are six degrees off the vertical. This inclination is specifically chosen to meet two needs. On the one hand, some inclination is needed so that the opening 28 into the cavity 24 will be somewhat larger than the head 30 of member 22 thereby allowing some tolerance for the initial alignment of the member 22 as it enters the cavity 24. On the other hand, the closer the inclination to vertical, the greater the resistance to lateral force, i.e. the greater the resistance to so-called "barrel torque."

Figure 6:
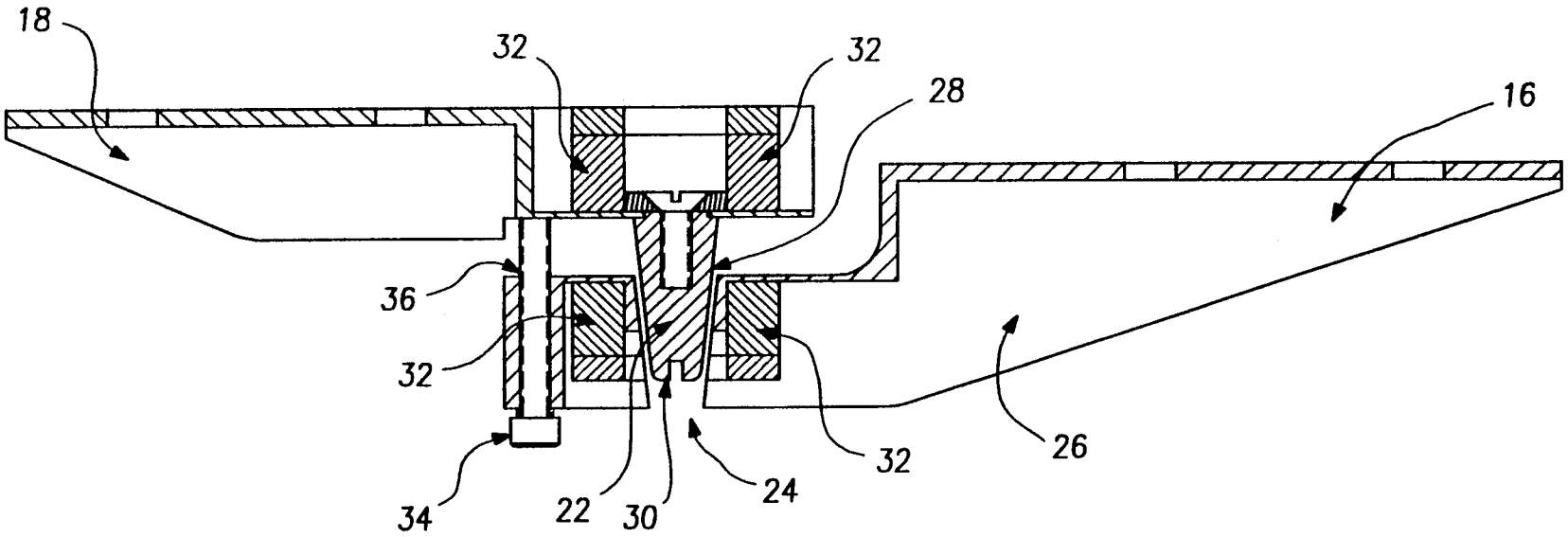
FIG. 6 shows the latching mechanism of FIG. 4 after disengagement.

In the preferred embodiment, magnets 32 are provided at the sides of the protruding member 22 and at the sides of the opening 28 of the cavity 24, as shown in FIG. 4. The plane of FIGS. 4 to 6 is chosen to contain the vector of the insertion of protruding member 22 and to be normal to the edges of adjoining panels 16 and 18.

As the descending panel 18 approaches the panel 16 already in position, as in FIG. 5, magnets 32 exert magnetic force to draw the panels 18 and 16 together and, once together, provide further holding force. In the preferred embodiment, the magnets 32 begin to exert significant force when the panels 18 and 16 are within one quarter of an inch from each other. Further, the magnets 32 exert a force of approximately twenty pounds, resisting separation of the latch, once the member 22 is fully seated.

A jacking screw 34 is inserted in a hole 36 in panel 16, and can be used to release the latching mechanism. When the jacking screw 34 is in a recessed position, the member 22 is allowed to seat fully. (See FIG. 4.) However, when the jacking screw 34 is turned, it moves out from its recessed position, as in FIGS. 4 and 5, and pushes panel 18 away from panel 16, as in FIG. 6. This disengages the magnets 32 and separates the two panels 18 and 16. While other release mechanisms are possible, the method of operation is significant. Since the apparatus must be as light weight as possible, the panels are fairly delicate. They may be easily damaged, if the magnetic force were overcome and the latches disengaged manually. Accordingly, a release mechanism which separates the panels without applying excessive force to the panels is necessary.

Since it is typically not necessary to disassemble an antenna dish once it is deployed in space, the jacking screw 34 may be used only to test the apparatus by repeatedly assembling and disassembling it prior to launch, and then removed from the apparatus which is actually launched to save weight.

The foregoing discussion discloses and describes merely exemplary methods and embodiments of the present invention. The present invention may be emboided in other specific forms without departing from the essential characteristics thereof. For example, the panels may be divided into three or more sets, each set rotated into position sequentially. Great variety is possible in the shape of the protruding member of the latching mechanism. A variety of release mechanisms are possible. It should be understood, therefore, that the invention is not limited to the specific embodiments described, but rather is defined by the accompanying claims.

What is claimed is:

1. A dish shaped assembly apparatus comprising:

a central base;

a plurality of panels having a narrow end proximal to the central base and a broader distal end, each panel having a protrusion located near one lateral edge of the panel at the distal end and which extends from the panel in a direction generally perpendicular to the planar surface of the panel at the location, and a cavity located near the opposite lateral edge of the panel at the distal end and which is adapted to receive and hold the protrusion of the adjacent panel; and a plurality of hinge means each of which is attached to the base and to a different one of the plurality of the panels for coupling the panels to the central base and for allowing the panels to rotate from a collapsed position to an expanded position, wherein the edges of the panels overlap each other and form a dish shaped assembly such that the protrusions on each panel is received and held by the cavity on the adjacent panel and the cavity exerts a lateral holding force on the protrusion.

2. The apparatus of claim 1, wherein the protrusion is substantially conical in shape.

3. The apparatus of claim 1, wherein the protrusion is substantially a frustum in shape.

4. The apparatus of claim 1, wherein a portion of the surface of the protrusion is inclined with respect to the base of the protrusion at an angle greater than forty-five degrees.

5. The apparatus of claim 4, wherein the protrusion is substantially conical in shape.

6. The apparatus of claim 4, wherein the protrusion is substantially a frustum in shape.

7. The apparatus of claim 6, further comprising:

magnetic means for providing an additional holding force for connecting adjacent panels to one another, and release means for releasing the latching means.

8. The apparatus of claim 7, wherein the release means comprises a jacking screw.

9. The apparatus of claim 1, further comprising a plurality of magnetic means for providing a holding force for connecting adjacent panels to one another.

10. The apparatus of claim 1 further comprising a release mechanism for releasing the protrusion from the cavity.

11. The apparatus of claim 10, wherein the release mechanism is a jacking screw.

12. A coupling apparatus for connecting a generally planar first member and a second member comprising:

a protrusion on the first member which extends in a direction generally perpendicular to the planar surface of the member at that location, wherein a portion of the surface of the protrusion is inclined with respect to the base of the protrusion at an angle of greater than forty-five degrees;

a cavity on the second member adapted to receive and hold the protrusion on the first member, such that the cavity exerts a lateral holding force on the protrusion; and magnetic means for providing an additional holding force between the first and second members.

13. The coupling apparatus of claim 12, wherein the protrusion is substantially conical in shape.

14. The coupling apparatus of claim 12, wherein the protrusion is substantially frustum shaped.

15. A coupling apparatus for connecting a generally planar first member and a second member comprising:

a substantially conical protrusion on the first member which extends in a direction generally perpendicular to the planar surface of the member at that location;

a cavity on the second member adapted to receive and hold the protrusion on the first member, such that the cavity exerts a lateral holding force on the protrusion; and magnetic means for providing an additional holding force between the first and second members.

16. The coupling apparatus of claim 15, wherein a portion of the surface of the protrusion is inclined with respect to the base of the protrusion at an angle of greater than forty-five degrees.

17. A coupling apparatus for connecting a generally planar first member and a second member comprising:

a substantially frustum shaped protrusion on the first member which extends in a direction generally perpendicular to the planar surface of the member at that location;

a cavity on the second member adapted to receive and hold the protrusion on the first member, such that the cavity exerts a lateral holding force on the protrusion; and magnetic means for providing an additional holding force between the first and second members.

18. The coupling apparatus of claim 17, wherein a portion of the surface of the protrusion is inclined with respect to the base of the protrusion at an angle of greater than forty-five degrees.

19. A method of assembling a dish shaped apparatus on a base, comprising the steps of:

providing a first plurality of panels;

rotatably attaching an edge of each panel in the first plurality of panels to the general circumference of the base with a space between each two adjacent panel edges;

providing a second plurality of panels;

rotatably attaching an edge of each panel in the second plurality of panels to the general circumference of the base such that the attached edges of the second plurality of panels lie in the spaces between the attached edges of the first plurality of panels;

rotating the first plurality of panels about the attached edges into a position such that they define portions of a dish shaped surface with a space between each two adjacent panels of the first plurality of panels;

rotating the second plurality of panels about the attached edges such that they overlap with and occupy the spaces between the first plurality of panels, and such that they define further portions of a dish shaped surface and;

providing magnetic means for attracting the edges of the second plurality of panels to the edges of the first plurality of panels and for drawing the second plurality of panels into the desired position when the second plurality of panels nears the spaces between the first plurality of panels.

20. The method of claim 19, further comprising the step of:

latching the first plurality of panels to the second plurality of panels.

21. The method of claim 22, wherein the step of latching the first plurality of panels to the second plurality of panels comprises providing on each panel a protrusion located near one edge of the panel which extends from the panel in a direction generally perpendicular to the planar surface of the panel at that location, and a cavity located near the opposite edge of the panel and which is adapted to receive and hold the protrusion of the adjacent panel.

* * * * *